United States Patent [19]

Kobayashi et al.

[11] 4,316,582

[45] Feb. 23, 1982

[54] DEVICE FOR PAINTING BY ELECTROSTATIC POWDER SPRAYING

[75] Inventors: Nobuo Kobayashi, Toyota; Hiroyoshi Kako, Aichi, both of Japan

[73] Assignee: Toyota Jidosha Kogyo Kabushiki Kaisha, Toyota, Japan

[21] Appl. No.: 142,660

[22] Filed: Apr. 22, 1980

[30] Foreign Application Priority Data

Oct. 3, 1979 [JP] Japan ..... 54/136256[U]

[51] Int. Cl.[3] ..... B05B 5/00

[52] U.S. Cl. ..... 239/692; 239/704

[58] Field of Search ..... 239/3, 690, 691, 692, 239/704, 405, 425, 426, 431; 118/627, 629–635; 427/27–30, 32–33; 361/226, 227

[56] References Cited

U.S. PATENT DOCUMENTS 4,071,192 1/1978 Myers ..... 239/3

4,090,666 5/1978 Peck ..... 239/692

4,225,090 9/1980 Kako et al. ..... 239/692

FOREIGN PATENT DOCUMENTS 53-77236 7/1978 Japan ..... 239/692

*Primary Examiner*—Andres Kashnikow

*Attorney, Agent, or Firm*—Finnegan, Henderson, Farabow, Garrett & Dunner

[57] ABSTRACT

A device for painting by electrostatic powder spraying including a nozzle member having a passage to which spray powder particles are supplied in a wafting state in air and in which the particles are triboelectrified. The nozzle member is provided with powder discharge windows from which the electrified powder particles are discharged and diffused by a diffuser. The inner wall of the nozzle passage, the peripheral walls of the windows and the surface of the diffuser are covered with fluorocarbon resin of a low friction coefficient.

4 Claims, 7 Drawing Figures

DEVICE FOR PAINTING BY ELECTROSTATIC POWDER SPRAYING

BACKGROUND OF THE INVENTION

This invention relates generally to a device or gun for painting powder particles, and more particularly to a device for painting powder particles by triboelectrification spraying.

Conventionally known are various types of devices for painting by electrostatic powder spraying, wherein, in general, a corona discharge is utilized for electrifying powder particles so as to electrostatically adhere said powder particles to a surface to be coated. According to this corona discharge device, a high electric voltage is applied to corona pins arranged so as to generate ions, powder particles are electrified by means of the corona ions thus generated, and at the same time the electrified powder particles are sprayed so as to adhere to the surface to be coated.

A typical conventionally known spray gun of this type is illustrated in FIG. 3. In this gun, spray powder particles supplied into a nozzle 1, in the direction indicated by an arrow A, are electrificated by corona ions which generate from corona electrodes 6 to which a high voltage is applied by means of high voltage source 5, when the powder particles pass through a conical gap between a diffuser member 3 fixed to a body 2 and a deflector 4 mounted on the nozzle member 1 at the right end thereof. In order to homogeneously disperse the powder particles and to form a uniform sprayed layer on a surface to be coated, narrow apertures 7 and an annular vortex chamber 8 are provided, so that the air supplied into the gun, as indicated by an arrow B, becomes a vortex air flow in the vortex chamber. In this gun, the nozzle member 1 and an annular member 9 defining the vortex chamber are made of brass. On the other hand, the other parts, indicated by hatchings, are made of any suitable resin material.

However, the conventionally known corona discharge spray gun mentioned above is known to have the following disadvantages.

1. The inner surfaces of the passages for the vortex air, especially the vortex chamber 8 into which the vortex air is discharged, tend to be easily worn away, thereby shortening the service life of the gun. In the case where the gun is continuously used, the service life thereof is usually one month. FIG. 4 is an enlarged view of the portion indicated by IV in FIG. 3, but illustrates the state of this portion after the gun has been used continuously for one month. Portions indicated by $L_1$ and $L_2$ of the annular chamber 8 which is defined by the nozzle member 1, the annular member 9 and the diffuser 3 are considerably worn away, and thereby the function of the vortex air generation is disturbed.

2. The spray powder particles adhere to the various portions of the gun and sometimes are dispersed in the state of lumps, which adhere to the surface to be coated, causing convex defects are formed on the sprayed surface. FIG. 5 is an enlarged view of a portion indicated by V in FIG. 3, but illustrates the state of this portion after the gun has been continuously used for four hours. The powder particles P have adhered to a step portion between the nozzle member 1 and the hose 10, thereby causing convex defects on the sprayed surface. FIG. 6 is an enlarged view of a portion indicated by VI in FIG. 3, but illustrates the state of this portion after the gun has been continuously used for four hours, wherein the powder particles P have adhered to the nozzle member 1 at the opposite side of the discharge ports 1*a*, thereby causing convex defects. FIG. 7 is an enlarged view of a portion indicated by VII in FIG. 3, but illustrates the state of this portion after the gun has been continuously used for four hours, wherein the powder particles also have adhered to the electrodes 6, thereby causing convex defects on the surface.

SUMMARY OF THE INVENTION

An object of the present invention is to provide a device for painting by electrostatic powder spraying which can obviate the above-mentioned problems in conventionally known devices.

Another object of the present invention is to provide such a painting device wherein members around the passage of the vortex air are prevented from being worn away, but, if these members do become worn away, making provision whereby the members can be easily exchanged, thereby extending the service life of the device.

A further object of the present invention is to provide a painting device wherein powder spray particles are prevented from adhering to various parts of the gun, thereby eliminating the formation of defects, such as convex defects, on the surface to be coated.

According to the present invention, a device for painting by electrostatical powder spraying comprises: a nozzle member having a passage to which spray powder particles are supplied in a wafting state in the air and in which the particles are triboelectrified, said nozzle member being provided with powder discharge windows at the peripheral wall of the discharge end of the nozzle, a diffuser member arranged so as to diffuse the powder particles discharged from said windows, vortex air generating means having an annular vortex chamber defined between said diffuser member and said windows, said means injecting vortex air to the powder particles being discharged from said windows, the inner wall of said passage of the nozzle member, the peripheral wall of said powder discharge window and the surface of said diffuser member being covered with fluorocarbon resin of a low friction coefficient, and said diffuser member being capable of being removed.

BRIEF DESCRIPTION OF THE DRAWINGS

An embodiment of the present invention will be explained in detail herein after with reference to the accompanying drawings, wherein.

DETAILED DESCRIPTION OF THE INVENTION

Figure 1:
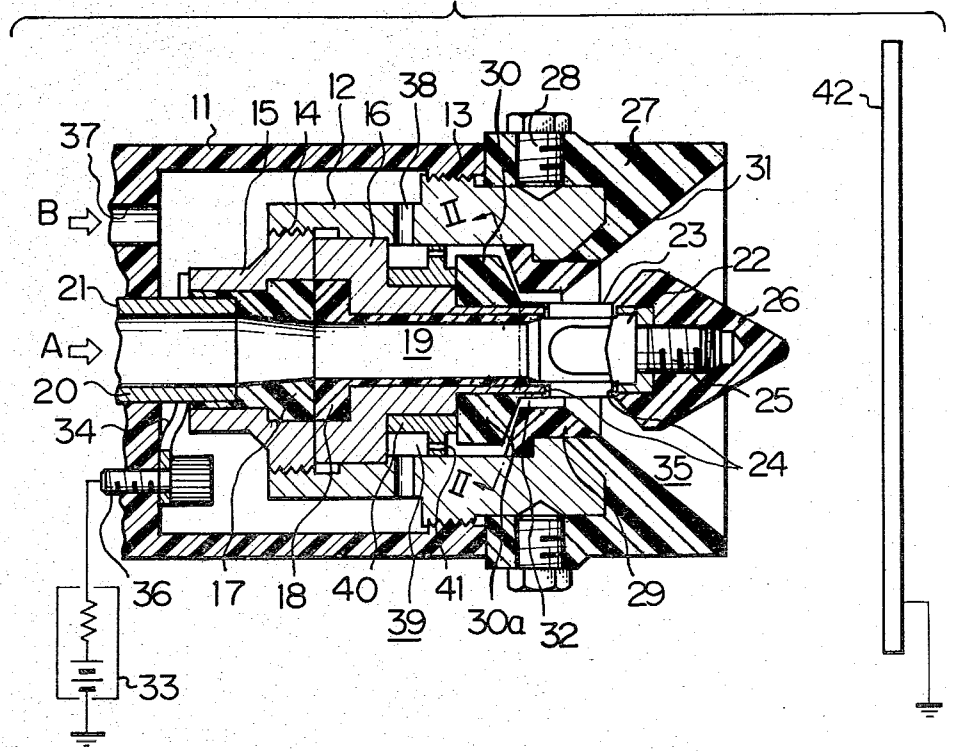
FIG. 1 is a cross-sectional view of a gun for painting by the electrostatic powder spraying of the present invention.
Figure 2:
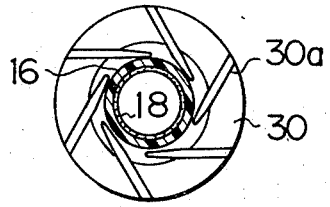
FIG. 2 is a cross-sectional view taken along line II—II in FIG. 1 and illustrating a vortex generator.
Figure 3:
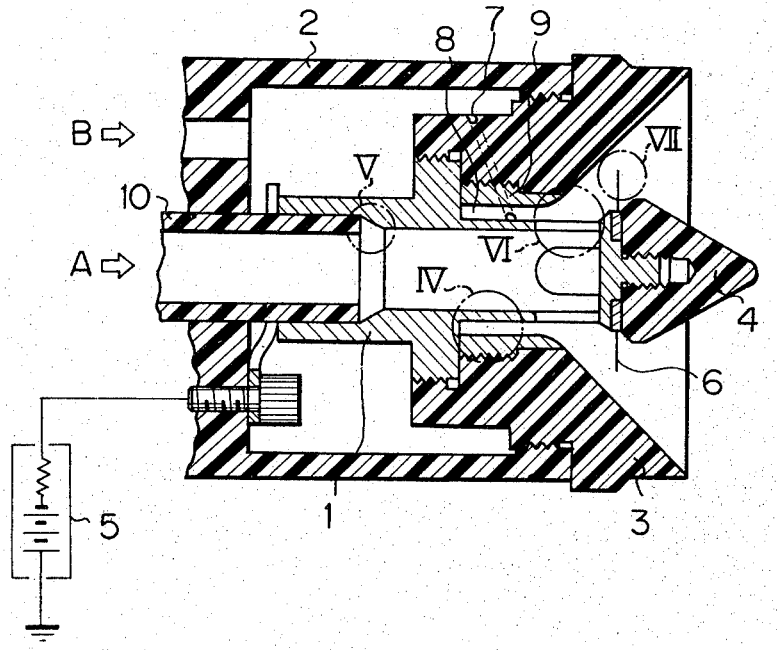
Fig. 3 PRIOR ART
FIG. 3 is a cross-sectional view of a conventionally known spray gun.
Figure 4:
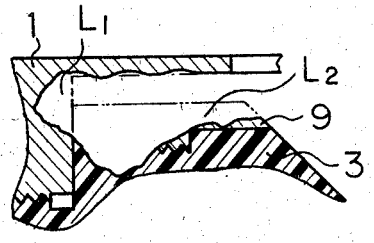
Fig. 4 PRIOR ART
FIG. 4 is an enlarged view of a portion indicated by IV in FIG. 3 and illustrating the state of abrasion of said portion; and, FIGS. 5, 6 and 7 are enlarged views of portions indicated by V, VI and VII in FIG. 3, respectively, and illustrating the state of powder adhered to said portions.
Figure 5:
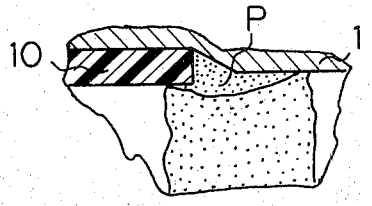
Fig. 5 PRIOR ART
Figure 6:
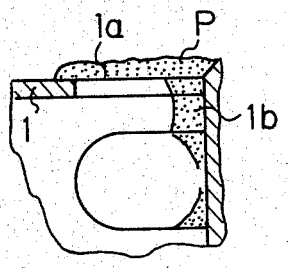
Fig. 6 PRIOR ART
Figure 7:
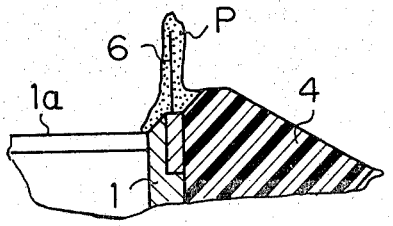
Fig. 7 PRIOR ART

Referring now to FIG. 1, a cylindrical housing 11 made of a suitable plastic material has an inner thread portion to which a cylindrical outer metal case 12 is screwed by an outer thread portion 13 thereof. Two inner metal cases 15 and 16 are rigidly secured to the outer metal case 12 by an outer thread portion 14 of the metal case 15. A pipe member 17 having a tapered passage and a pipe member 18 having a cylindrical passage are tightly fitted to the inner walls of the inner pipe members 15 and 16, respectively. These pipes 17 and 18 are made of fluorocarbon resin, usually referred to as "Teflon" (Trademark), and cooperate to define and electrification passage 19.

One end of the tapered passage of the Teflon pipe 17, which has a larger diameter, is connected to a powder supply hose 21 which is secured to an aperture 20 of the housing 11 and is connected to a painting powder particle supply hopper, not illustrated in the drawings. Between the hose 21 and the Teflon pipe 17 and between the Teflon pipes 17 and 18 are smoothly connected, so that no steps are formed therebetween.

The inner metal case 16 is provided at the periphery of the right end thereof, in FIG. 1, with a plurality of powder discharge windows 23 spaced at the same angle to each other. The peripheral walls of these windows 23 are coated with Teflon materials 24. At the right end of the inner metal case is a head 22. A screw pin 25 projects from the right end of the head 22 of the inner metal case. A substantially conical deflector member 26 made of Teflon is rigidly secured to the screw pin 25.

A large diffuser member 27 made of Teflon is rigidly secured to the outer metal case 12. Between the inner metal case 16 and the outer metal case 12 there are interposed a small diffuser member 29 and an annular vortex generator 30, which are both made of Teflon. The small and large diffusers 29 and 27 cooperate to define a conical surface positioned around the powder discharge windows 23 and serve to diffuse the powder particles discharged from the windows. Between the small diffuser 29 and the injection windows 23, and annular vortex chamber 23 is defined. The vortex generator 30 is provided on the surface thereof, which contacts with the small diffuser 29 with a plurality of radially arranged recesses 30*a*.

The plastic housing 11 supports a metal bolt 36 which is connected to a high voltage source 33 so that high voltage (plus) is applied to the inner metal cases 15 and 16 through a wire 34.

Painting powder particles are supplied in a wafting state in the air from the hopper (not shown) through the powder particle supply hose 21 to the spray gun, in the direction indicated by arrow A. The transferring speed of the powder particles is increased in the tapered passage of the Teflon pipe 17, because the cross-sectional area of the passage is gradually reduced, and then the powder particles pass through the Teflon pipe 18. The Teflon pipe 18 is static-electrified (the opposite pole of that of the powder particles, i.e. negative pole) so that the powder particles are frictionally electrified to a positive pole while passing through the passage 19. On the other hand, because the Teflon pipe 18 has a thin wall, the electric charge (negative pole), opposite to the electric charge (plus pole) of the powder particles created by friction on the inner surface of the Teflon tube 18, is easily released to the inner metal cases 15 and 16 (or to the ground), thereby enabling continuous and highly efficient electrification. In addition, because a high voltage of a plus pole is applied to the inner metal cases 15 and 16 by the high voltage source 33, the metal cases 15 and 16 create an outside electric field for the electrified particles, as well as promote the transport of the negative electric charge created on the inner wall of the Teflon pipe 18.

The electrified powder particles are passed through the passage 19 and discharged from the windows 23, and then the particles are dispersed toward the surface 42 to be coated through a conical passage 35 defined between the large and small diffusers 27 and 29 and the deflector 26. The surface 36 is connected to the ground, so as to be electrically charged (to negative) opposite to the charge of the electrified powder particles.

In order to disperse the powder particles as homogeneously as possible and to form a uniform sprayed layer on the surface 36, auxiliary air is used. The auxiliary air is supplied into the gun through an air inlet 37 of the housing 11, in the direction indicated by arrow B, and flows into an annular chamber 39 from air ports 38 formed in the outer metal case 12. An annular member 40 having narrow air ports 41 is inserted into the annular chamber 39. Therefore, the auxiliary air passes through these narrow air ports 41 and a strong vortex of air is injected into the vortex chamber 32 through the recesses 30*a* of the vortex generator 30. The electrified powder particles discharged from the windows 23 are homogeneously spread by the vortex air flow and transferred through the conical passage 35, the diameter of which becomes gradually larger, so that the speed of the powder particles in the vortex flow is gradually reduced, and thereby a uniformly sprayed layer is formed on the surface 36. Because it is difficult to accurately machine the recesses 30*a* of the vortex generator 30, the annular member 40 is provided with said narrow apertures 41. That is to say, the amount of the auxiliary air is accurately controlled by means of the apertures 41, the dimension of which can be more accurately determined by maching then that of the recesses 30*a*. In addition, the amount of the auxiliary air can be changed by changing the annular member 40 with another one having narrow apertures of different diameters.

The advantages of the spray gun of the present invention, in comparison with a conventionally known device, are as follows:

(1) Although the vortex air is injected into a relatively small size vortex chamber 32, because the inner wall of the chamber 32 is lined with Teflon material that has a low friction coefficiency, the inner wall of the chamber is not easily worn away, so that a durable and long-life spray gun can be obtained. If the parts, such as the small diffuser 29, the vortex generator 30 and so on, are worn away, they can be exchanged by removing the screws 28. The amount of the vortex air can be accurately controlled by the narrow apertures 41 of the annular member 40.

(2) There are no corona pins in the passage 35 between the large and small diffuser 27 and 29 and the deflector 26, and the metal surface of the passage 35 is completely covered with Teflon material, so that corona discharge is prevented from occurring. The passage of the spray powder particles extends smoothly and the inner wall thereof is coated with Teflon material of a low friction coefficient, so that the powder particles do not easily adhere to the gun and, therefore, convex defects are prevented from occurring on the surface to be coated.

We claim:

1. A device for painting by electrostatical powder spraying, which device comprises: a nozzle member having a passage to which spray powder particles are supplied in a wafting state in air and in which the particles are triboelectrified, said nozzle member being provided with powder discharge windows at the peripheral wall of the discharge end of the nozzle, a diffuser member arranged so as to diffuse the powder particles discharged from said windows, vortex air generating means having an annular vortex chamber defined between said diffuser member and said windows, said means injecting vortex air to the powder particles discharged from said windows, the inner wall of said passage of the nozzle member, the peripheral wall of said powder discharge window and the surface of said diffuser member being covered with fluorocarbon resin of low friction coefficient, and said diffuser member being capable of being removed.

2. A device as set forth in claim 1, wherein a deflector member is mounted at one end of said nozzle member, so that a conical passage for diffusing the powder particles discharged from said windows is defined between said deflector member and said diffuser member, and the surface of said deflector member is also coated with fluorocarbon resin.

3. A device as set forth in claim 1, wherein said vortex air generating means comprises an annular vortex generator, which is provided with a plurality of radial recesses on the surface thereof which contact with said diffuser member, and said surface of the vortex generator is also covered with fluorocarbon resin of a low friction coefficient.

4. A device as set forth in claim 1, 2 or 3, wherein said fluorocarbon resin is Teflon.

* * * * *